US006152760A

United States Patent [19]

Reeser

[11] Patent Number: 6,152,760

[45] Date of Patent: Nov. 28, 2000

[54] PIVOTING WIRE CARRIER FOR AERIAL DROP WIRE AND TERMINAL THEREFOR

[75] Inventor: Nancy Lee Reeser, Lemoyne, Pa.

[73] Assignee: The Whitaker Corporation, Wilmington, Del.

[21] Appl. No.: 09/273,630

[22] Filed: Mar. 23, 1999

[51] Int. Cl.[7] ..... H01R 11/20; H01R 4/24; H01R 4/26

[52] U.S. Cl. ..... 439/409; 439/395; 439/410

[58] Field of Search ..... 439/409, 395, 439/396, 410, 417

[56] References Cited

U.S. PATENT DOCUMENTS

| | | | |
|---|---|---|---|
| 4,341,430 | 7/1982 | Crawford | 339/99 |
| 4,722,699 | 2/1988 | Heng et al. | 439/396 |
| 5,059,137 | 10/1991 | Dale et al. | 439/395 |
| 5,281,164 | 1/1994 | Gan | 439/409 |
| 5,557,250 | 9/1996 | Debbaut et al. | 338/21 |
| 5,667,402 | 9/1997 | Denovich et al. | 439/409 |
| 5,685,733 | 11/1997 | Denovich et al. | 439/395 |
| 5,785,548 | 7/1998 | Capper et al. | 439/409 |
| 5,863,215 | 1/1999 | Debbaut et al. | 439/412 |

OTHER PUBLICATIONS

Alpha–Tel Drop Wire, Specification 5004, MPC No. 386, Article; 3 Pages; Oct. 1979; General Cable, Woodbridge, NJ.
AMP Dwg. No. C–569963, Pivot Connector.
Clifford Drop Wires, Aerial, Self–Supporting; 1 Page; Date N/A; Clifford Inc., Bethel, VT.
Rubber Insulated, Neoprene Jacketed Drop Wire–Type GT–7, Specification 4253, MPC No. 086; 4 pages; Feb. 1975; General Cable, Woodbridge,.

*Primary Examiner*—Paula Bradley
*Assistant Examiner*—Edwin A. León

[57] ABSTRACT

Connector (10) including a wire carrier (14) for terminating a wire (18) to a terminal (60) affixed in housing (12) through insulation displacement. Terminal (60) includes reinforced beam portions (64) along either side of IDC slot (62) for stiffening the beam portions for use with 18.5 AWG Aerial drop wire. Wire carrier (14) is pivotable from an open position to a closed position after an insulated wire (18) has been inserted fully into wire-receiving passageway (20), and is locked in the closed position by locking section (54) of the housing (12).

12 Claims, 6 Drawing Sheets

PIVOTING WIRE CARRIER FOR AERIAL DROP WIRE AND TERMINAL THEREFOR

FIELD OF THE INVENTION

This relates to electrical connectors and more particularly to connectors for termination of conductor wires.

BACKGROUND OF THE INVENTION

In order to terminate an end of a conductor wire, it is known from U.S. Pat. No. 5,667,402 and others to provide a terminal within a housing and provide an upper portion defining an IDC slot where the upper portion extends outwardly of the housing. The housing has affixed thereto a pivotable wire carrier section that defines a wire-receiving aperture extending to and past a location just above a wire-terminating slot of the terminal when the pivotable section is in an open or wire-receiving position. After the end of the still-insulated wire end is inserted into the aperture, the wire carrier is then pivoted toward the terminal to force the wire and into the wire-terminating slot so that edges of the beams to either side of the slot penetrate the insulation end engage compressively with the wire conductor therewithin, in an insulation displacement connection (IDC). Such pivotable wire carriers are known to be used with wire having a 22 AWG (core diameter of 0.025 in.) or 24 AWG (core diameter of 0.020 in.), and rely on compressive engagement with the copper core involving some deflection of the beams of the terminal and some deformation of the copper.

Insulated steel core wire known as Aerial Drop Wire ("F" Drop) is utilized for two-conductor (tip and ring) cable strung to extend from a junction with telephone distribution cable at a telephone pole, to the Network Interface Device located on the outside of a subscriber's residence, where the wire is interconnected with premise wiring of the subscriber. Such exposed, freehanging cable is exposed to the elements, in many areas including icing in winter, and must include a tough insulative jacket and strength cores to sustain its own weight over distance and time without stretching. A copper-clad steel core satisfies the strength requirement with the copper-cladding therearound satisfying the conductivity requirement, as well; if all-copper conductive cores are utilized, then additional steel members must be provided within or joined to the cable. But for use of known pivotable wire carriers with 18.5 AWG Aerial drop wire, it is required to strip most of the insulation from the conductor wire prior to pressing into the slot in order to successfully terminate the wire at the connector module, for interconnection with a corresponding conductor of the premise wiring of the subscriber, since the beams of the terminal adjacent the IDC slot are deflectable and cannot reliably penetrate the tough insulation and assuredly compressively engage the conductive core; alternatively, a tool is utilized to close the connector.

It is also known from U.S. Pat. Nos. 5,557,250 and 5,863,215 to provide a planar terminal with a closed wire-receiving aperture at the entrance to the IDC slot, in order to assuredly hold together the ends of the beams defining the IDC slot for the cutting edges of the beams along the slot to assuredly penetrate the substantial thickness of insulation surrounding the conductor wire therewithin, for otherwise the beams would be deflected either laterally or twist or rotate. However, the existence of such a section holding together the ends of the beams of the planar terminal, as in U.S. Pat. No. 5,685,733, would substantially increase the height of the terminal above the wire-insertion aperture of both the terminal and the wire carrier and thus would interfere with pivoting movement of the wire carrier unless a clearance of substantial width and height were defined that would not be desirable in the known wire carrier design, resulting in either a larger, bulkier wire carrier or possibly weakening its strength, or undesirably exposing the terminals.

It is desired to provide a pivotable wire carrier that is useful with unstripped 18.5 AWG Aerial drop wire with a conductive core of about 0.035 to about 0.039 in. and an insulative jacket outer diameter of from 0.064 in. (for copper wire) to 0.180 in. (for copper clad steel wire).

It is desired to provide a terminal with an IDC section adapted to be used with 18.5 AWG Aerial drop wire.

It is desired to provide a low height terminal useful with 18.5 AWG Aerial drop wire, for use in a pivotable wire carrier providing IDC termination.

SUMMARY OF THE INVENTION

The present invention provides a terminal useful in a pivotable wire carrier for IDC termination of Aerial drop wire. A pair of beam portions define an IDC slot in a plate portion of the terminal and extend upwardly to the entrance of the IDC slot with upper portions extending from an upper terminal edge for a limited height above the terminal's general upper edge. The upper portions include upwardly facing edges angled inwardly to provide a generous lead-in to the entrance to the IDC slot and that are sharpened to define insulation-cutting edges along the entrance.

In one aspect of the invention, the beam portions adjacent to the narrow IDC slot (inwardly from the entrance) include tab portions that extend laterally and then rearwardly at right angles from the plane of the plate portion, thus providing substantial rigidity to the slot-adjacent beam portions for resistance to deflection and to deformation upon insertion of an Aerial drop wire along the IDC slot for IDC termination. Tab portions simulate the rigidity otherwise obtained with thicker stock material for the beams, thus permitting thinner stock that requires less height to obtain the cutting edges along the IDC slot entrance. The insulative wire carrier member defines a clearance above the wire-insertion slot complementary to the entrance-defining upper beam portions, and also a clearance for upper edge portions of the laterally and rearwardly extending tab portions when the wire carrier is pivoted downwardly during termination of the Aerial drop wire.

In another aspect of the invention, the housing includes a post forwardly of the wire carrier and offset to one side of the wire-receiving passage, that extends upwardly through an aperture through the front portion of the actuation lever, and a locking section on the post projects through the aperture and into a slot to be exposed for delatching by a tool. The post, and a second similar post offset to the other side, anchor the wire carrier against lateral movement from lateral stresses. The wire carrier in turn protects the posts from damage.

In another embodiment of terminal, the upper portions of the beams are elongate, narrow, sharply pointed teeth all edges of which are knife edges, diverging only slightly at the IDC slot entrance, for improved initial penetration of the Aerial drop wire insulation. The wire carrier clearance for the teeth would be sufficiently extended vertically to accommodate the elongate teeth while still providing insulative material thereover.

Embodiments of the wire carrier and embodiments of the terminal therefor will now be described by way of example with reference to the accompanying drawings.

DETAILED DESCRIPTION

Figure 1:
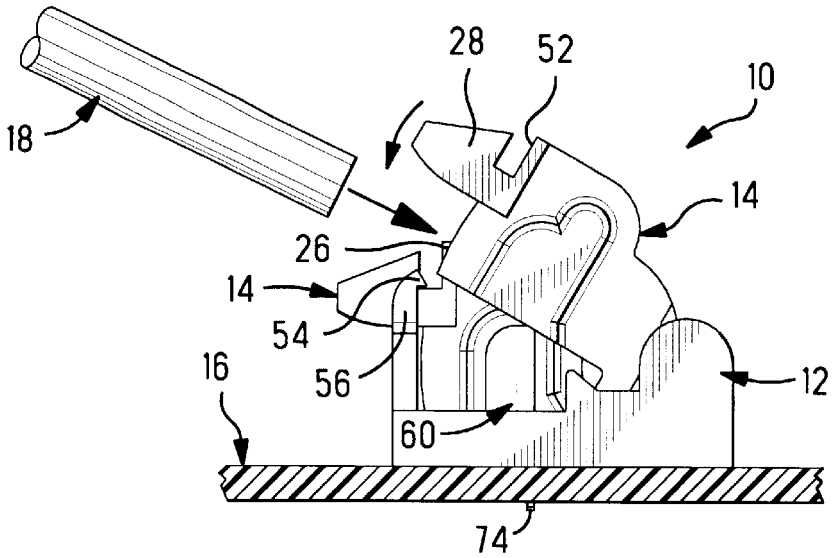
FIGS. 1 and 2 are elevation views of the connector assembly with the wire carrier in its open position with a wire end to be inserted, and its closed position after wire insertion.
Figure 2:
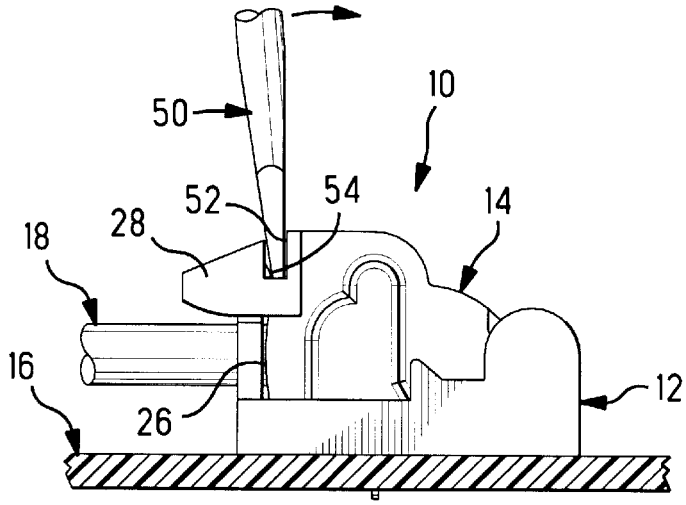

Connector assembly 10, shown in FIGS. 1 to 4, includes an insulative housing 12 and an insulative wire carrier 14 pivotably mounted to the housing along the top face thereof. Assembly 10 is shown in FIGS. 1 and 2 mounted onto a circuit board 16 and may be part of a Network Interface Module (NID), for example, for interconnecting circuits of a telephony distribution cable to premise wiring of a subscriber. Wire 18 may be one of the separately insulated tip and ring conductors of 18.5 AWG Aerial Drop cable (not shown) that has been split from the other wire of the cable at the cable end for termination in respective wire carriers of the assembly. In a manner similar to that disclosed in U.S. Pat. No. 5,667,402, the wire end, still insulated, is inserted into the wire-receiving passageway 20 of wire carrier 14 until abutting wire stop 22 rearwardly of the termination region, after which wire carrier 14 is pivoted downwardly against housing 12, in turn urging wire 18 into the IDC slot 62 of terminal 60 (see FIGS. 11 and 12).

Figure 6:
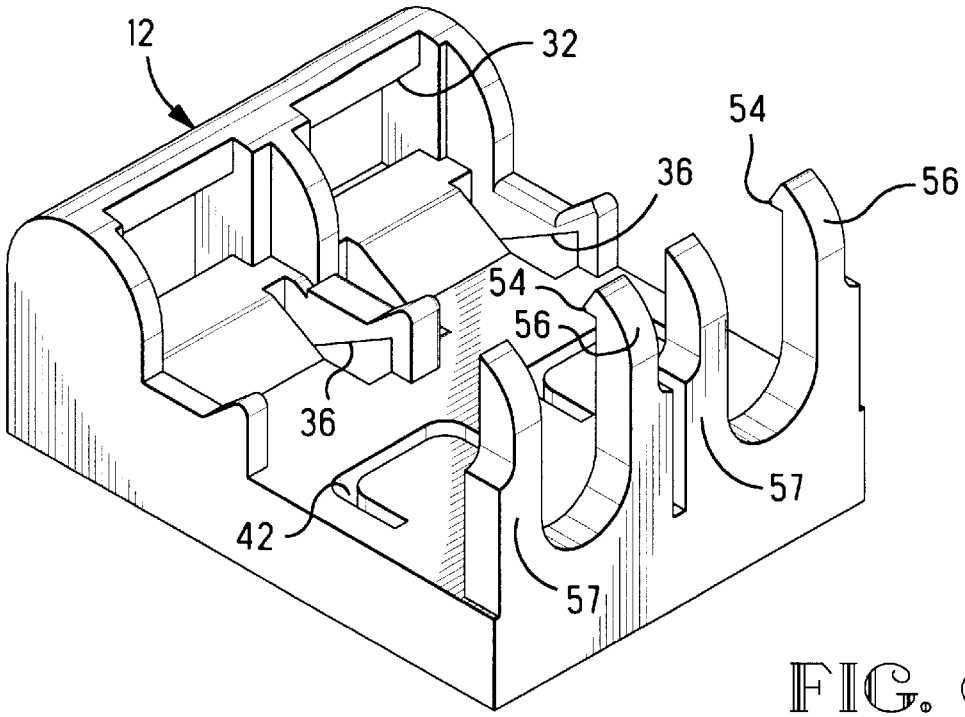
FIGS. 6 and 7 are isometric views of the housing of FIGS. 1 to 4.
Figure 7:
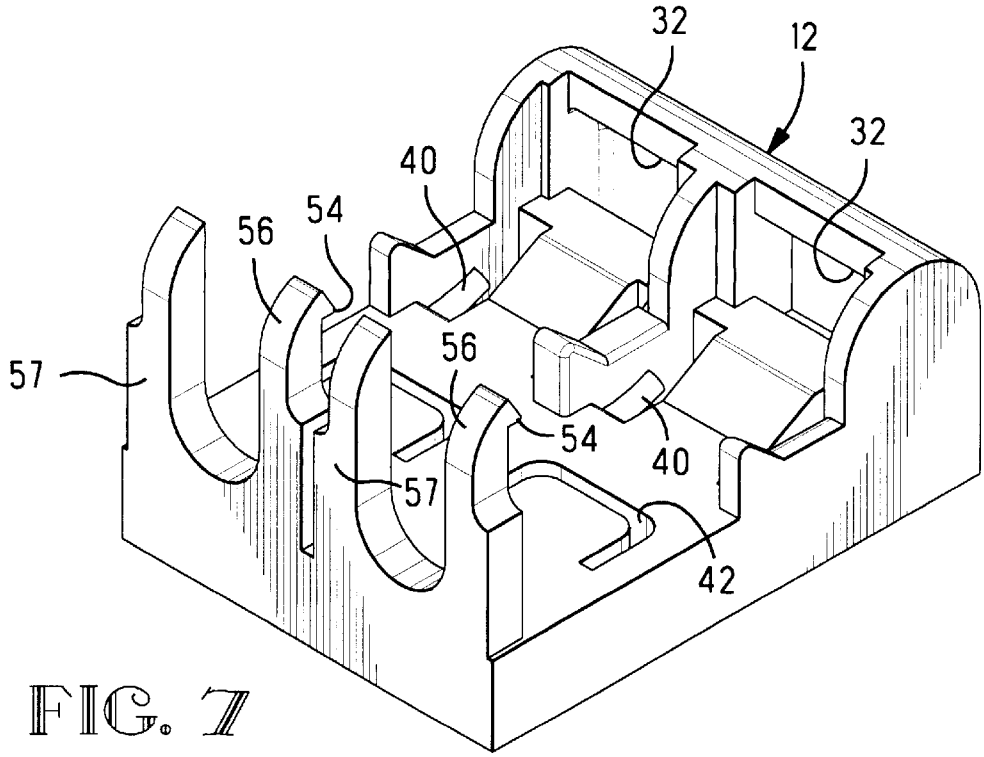
Figure 10:
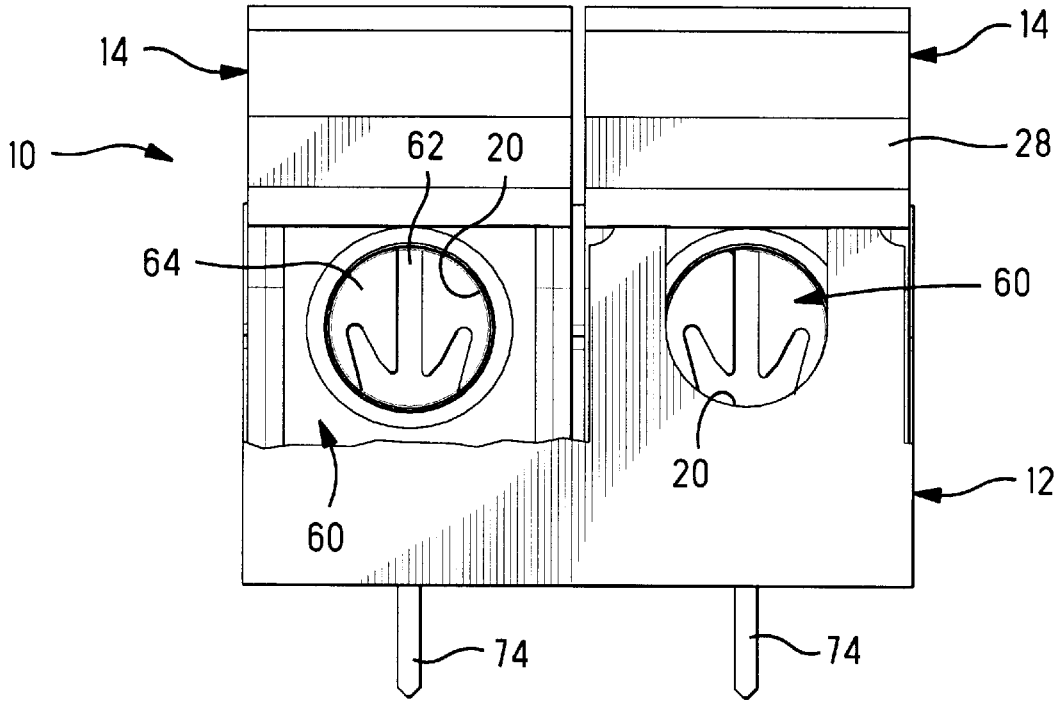
FIG. 10 is an elevation view of the front of the assembly of FIGS. 8 and 9, wherein the wire carriers are shown in their closed positions but without wires inserted thereinto.

Housing 12 may have provisions for two or more wire carriers for terminating numerous respective tip and ring conductors, with the assembly 10 shown in FIG. 10 as having two wire carriers 14, for termination to tip and ring wires of a single two-conductor aerial drop cable. Each wire carrier 14 includes one wire-receiving passageway 20 extending into front face 26 thereof, beneath an actuation lever 28 that is adapted for manual actuation. Each wire carrier 14 includes a pivot section 30 seated within a complementary pivot seat 32 of housing 12. A work end of a tool 50 such as a screw driver is shown in FIG. 2 for use in delatching the wire carrier for removal of the wire during servicing. The tool work end is insertable into a slot 52 of the wire carrier near the forward end of actuation lever 28 to engage a latch 54 of the housing (see FIGS. 5 to 7).

Figure 8:
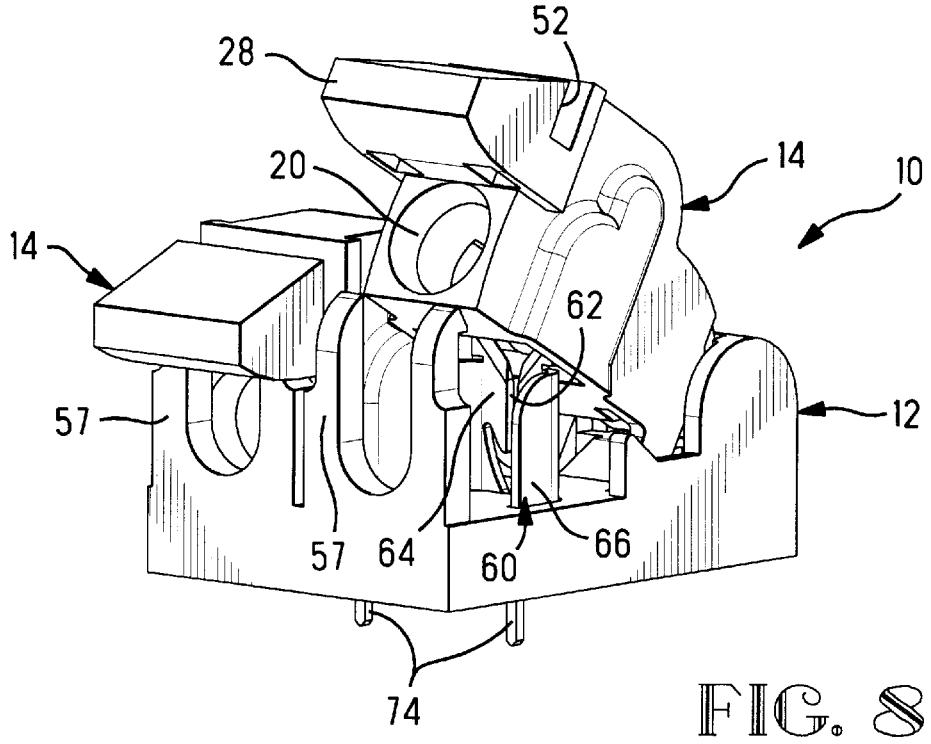
FIGS. 8 and 9 are isometric views of the assembly of FIGS. 1 to 4.
Figure 9:
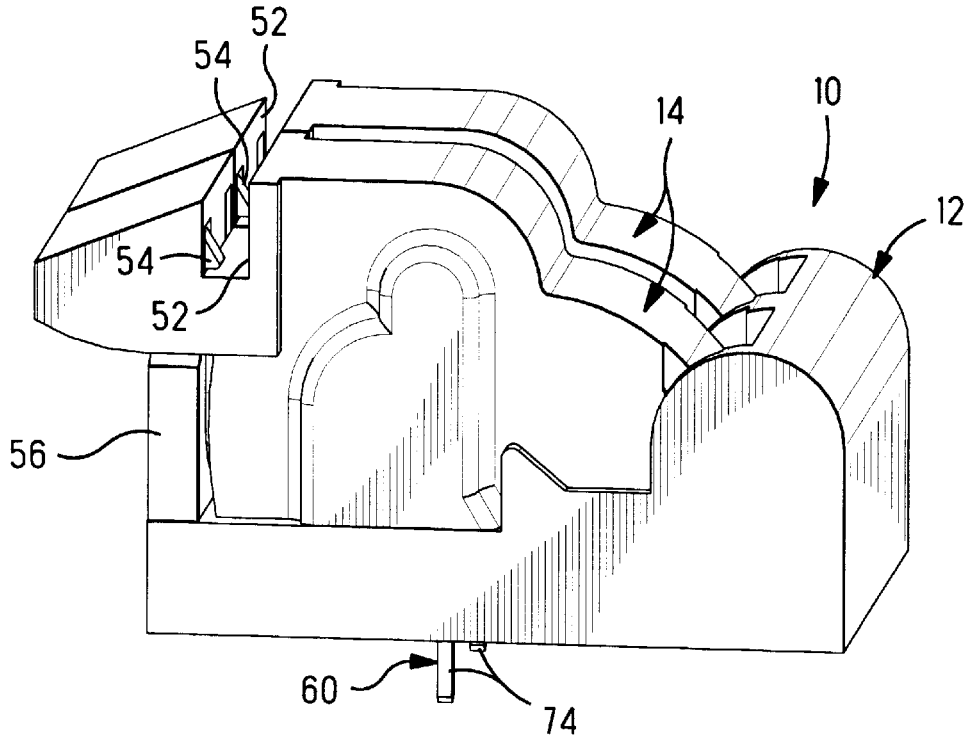

Referring now to FIGS. 5 to 9, housing 12 includes a latch 54 on an upstanding post 56 just forwardly of the front end of wire carrier 14 and offset to one side of the wire-receiving passage 20. Post 56 is received into a first aperture 58 through a front portion of actuation lever 28 enabling latch 54 to protrude into slot 52 when the wire carrier has been pivoted to its closed position, in order to lock the wire carrier in its closed position and be engageable by tool 50 for delatching (FIGS. 2 and 9). A second upstanding post 57 extends upwardly offset to the other side of the wire-receiving passage, and extends through a second aperture 58 through the actuation lever. The two posts 56,57 anchor the wire carrier against any lateral motion urged by stresses on the stiff wire 18 tending to bend it laterally forwardly of the module. The wire carrier in turn protects the posts from damage.

A stopping section 34 is defined on a depending leg of the wire carrier proximate its rearward end, and cooperates with a corresponding stopping section 36 of housing 12 along one side of the carrier (see FIG. 6), that stops upward movement of the wire carrier after being pivoted upwardly to its fully open position which may be at an angle of about 30°. Stopping section 34 is shown as a latch projection (FIG. 5), while corresponding stopping section 36 is a downwardly facing ledge (FIG. 6).

Figure 3:
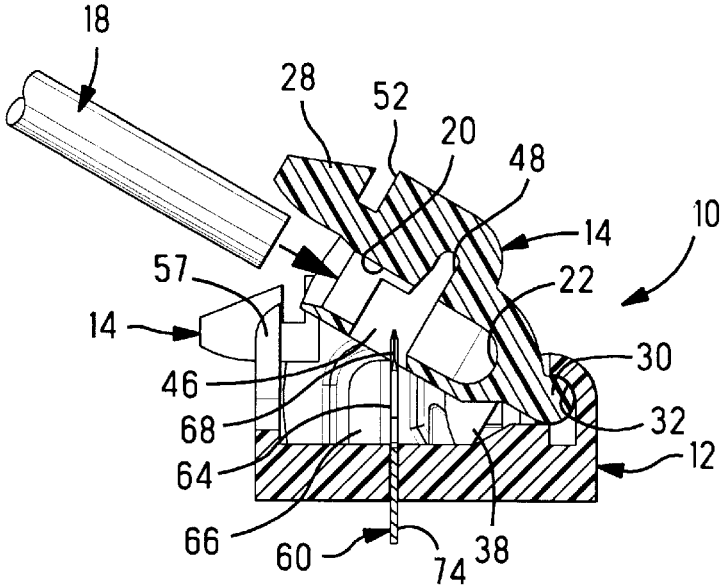
FIGS. 3 and 4 are longitudinal section views of the connector of FIGS. 1 and 2.
Figure 4:
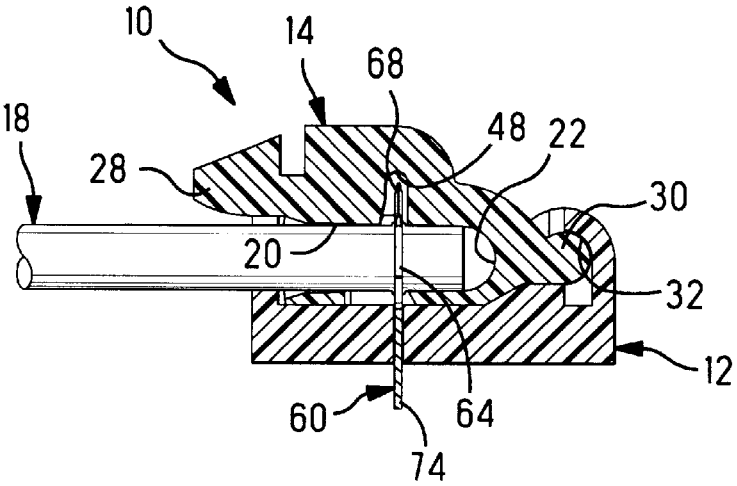

Each wire carrier 14 further includes a detent section 38 (see FIG. 5) on a depending leg near the rearward end of the wire carrier that cooperates with corresponding detent section 40 on the housing wall to support the wire carrier in the fully open position as in FIG. 3. Detent section 38 is preferably rounded, with corresponding detent section 40 on the housing also being preferably a rounded protrusion that extends arcuately along a wall of the housing, to facilitate riding of the detent section 38 over the detent section 40 during closing of the wire carrier and also during intentional delatching to permit pivoting of the wire carrier upwardly when actuation lever 28 is manually pried upwardly. Placement of the detent section 38 and the stopping section 34 rearwardly of the terminal minimizes the length of the depending legs (or the height of the housing walls containing the cooperating detent and latching sections), since actual travel distance is reduced rearwardly of the terminal compared to locations forwardly of the terminal for the same angular distance.

Figure 11:
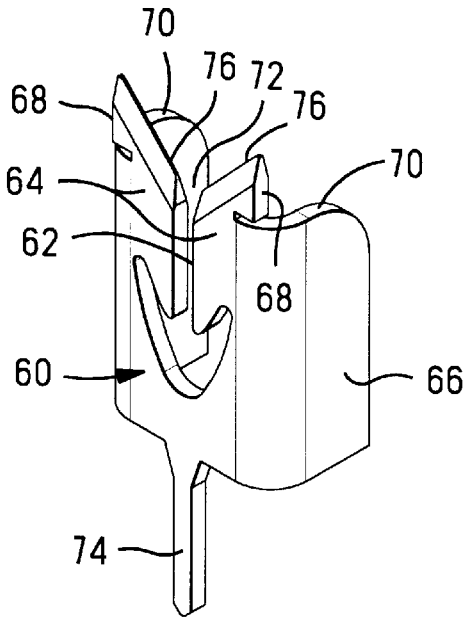
FIGS. 11 and 12 are isometric and front elevation views of the terminal of the present invention.
Figure 12:
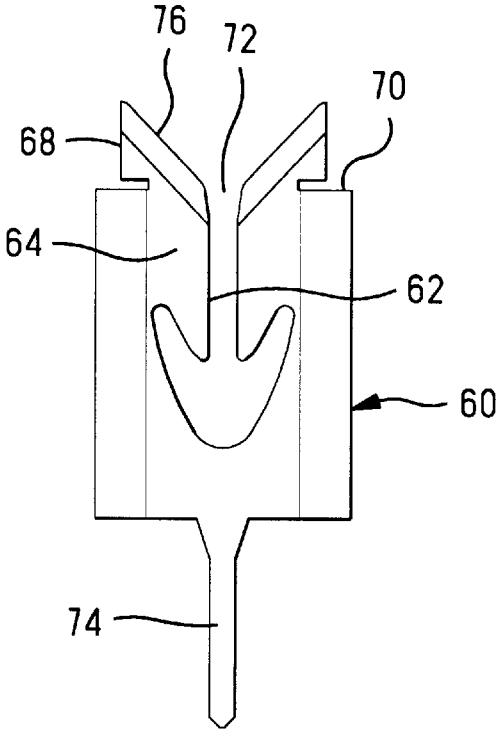

Terminal 60 is seen in FIGS. 11 and 12 to have beam portions 64 that define therebetween IDC slot 62. Beam portions 64 are disposed in a common plane and extend laterally to tab portions 66 that are bent orthogonally to extend from beam portions 64 at both sides of the terminal. Terminal 60 is seated into U-shaped opening 42 in housing 12 preferably by force-fit such as by using plastic-penetration retention dimples or barbs (not shown) as is conventionally used with some kinds of terminals, with the tab portions 66 preferably extending forwardly from beam portions 64 and abutting a ledge within the U-shaped opening to resist being rotated forwardly during wire termination. Beam portions 64 extend upwardly to upper portions 68 that protrude beyond the upper edge 70 of terminal 60 and define an entrance 72 to IDC slot 62. Upper portions 68 include upwardly facing edges that are angled toward each other and are chamfered into cutting edges 76 that provide a wide entrance 72. Terminal 60 is also seen to include a post contact section 74 that depends outwardly beneath housing 12 for insertion into a through-hole of circuit board 16 to be soldered to a circuit thereof.

Figure 5:
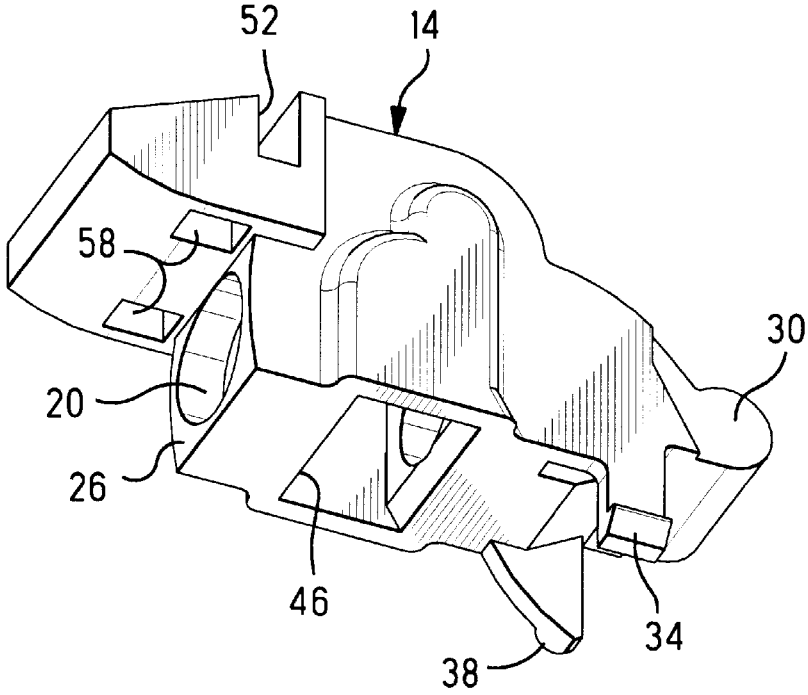
FIG. 5 is an isometric view of the wire carrier of FIGS. 1 to 4.

Referring to FIGS. 3, 5 and 8, terminal-receiving recess 46 of wire carrier 14 is in communication with wire-receiving passageway 20, and includes a cavity 48 to receive thereinto upper portions 68 of beam portions 64 of terminal 60; forwardly of cavity 48, recess 46 receives thereinto tab portions 66, all when the wire carrier is pivoted into its closed position.

Figure 13:
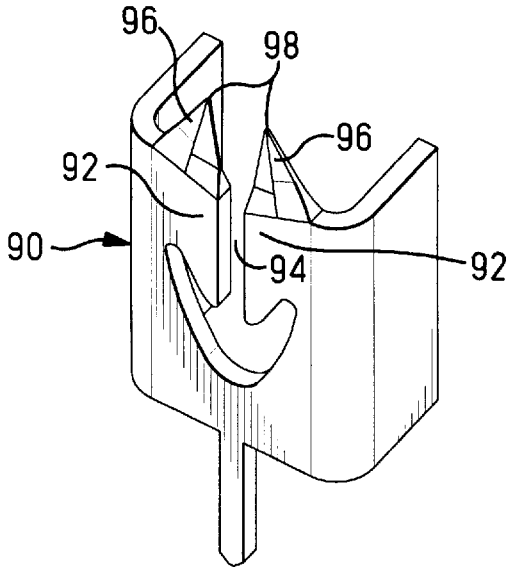
FIGS. 13 and 14 are isometric and front elevation views of a terminal of a second embodiment of the invention.
Figure 14:
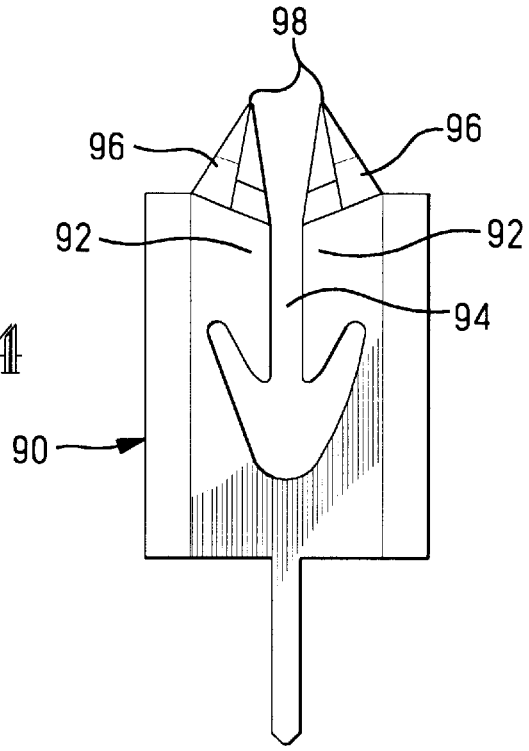

Another embodiment of terminal 90 for IDC termination of 18.5 AWG Aerial drop wire is disclosed in FIGS. 13 and 14. Beam portions 92 define therebetween the IDC slot 94. Upwardly extending portions 96 are shaped as elongate, narrow, sharply pointed teeth having points 98, and having all edges chamfered into sharp knife edges to facilitate initial penetration into the insulation of the wire as the wire is urged downwardly between the teeth and into IDC slot 94. Elongate portions 96 penetrate the wire insulation with less force, facilitating termination. A wire carrier for terminal 90 (not shown) would be modified to provide clearance that is complementary for the teeth 96; the wire-receiving passageway would be higher relative to the terminal to permit the wire to be positioned higher with respect to the entrance to the IDC slot, since the lead-in is longer than that for the terminal of FIGS. 11 and 12.

Terminals 60,90 would be made of appropriate alloy, such as beryllium copper, and have a sufficient stock thickness, such as about 0.020 in. Wire carrier 14 could be made of, for example, a thermoplastic resin such as polybutylene terephthalate. IDC slots 62, 94 would preferably have a width of about 0.028 in. for use with 18.5 AWG wire having a conductive core total width of about 0.039 in. comprising a steel core of about 0.035 in. with copper cladding thereover all within an insulative jacket of "D" shape having a diameter of about 0.180 in. although some varieties have an insulative jacket diameter of about 0.130 in. To press the ends of the 18.5 AWG aerial drop wires into IDC slots during termination, sizable forces are necessary, such as over 30 lbs., and reaching over 40 lbs. or so in cold weather due to properties of the insulation material, and the wire carrier and terminal of the present invention enable manual termination. Preferably the leading end of the actuation lever is adapted to direct the manual forces directly downwardly rather than forwardly, and the top surface is therefore preferably beveled until almost horizontal in the open position (FIG. 3), which also reduces the height of the assembly when the wire carrier is in the open position.

Figure 15:
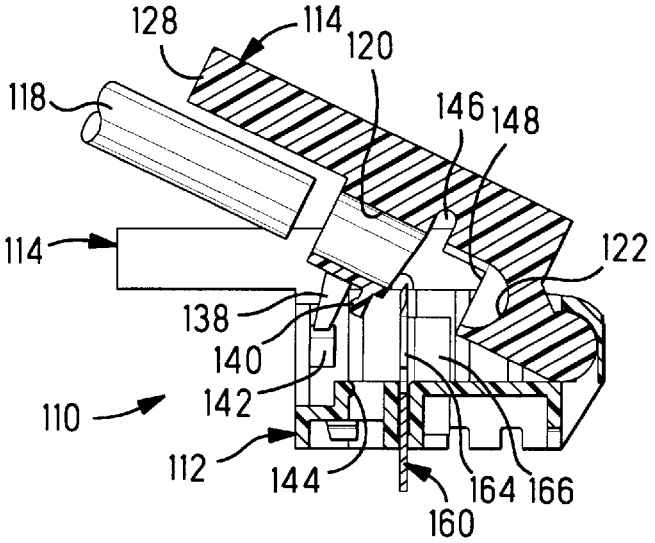
FIG. 15 is a cross-sectional view of a second embodiment of wire carrier assembled to a housing, and a wire being inserted thereinto.

Another embodiment of assembly 110 is shown in FIG. 15, having housing 112 and wire carrier 114 having wire-receiving passageway 120 for wire 118 extending to wire stop 122. Clearance region 146 is seen forwardly of terminal-receiving slot 148 of terminal 160. Upper edge portions of beam portions 164 and rearwardly extending tab portions 166 will extend into the clearance region 146 and the terminal-receiving slot 148, respectively, when the wire carrier is pivoted into its closed or terminated position. Each wire carrier 114 includes a latching section 140 that latchingly engages a corresponding latching section 144 of housing 112 after the wire carrier has been fully pivoted into the closed or wire-terminating position, in order to retain the wire carrier in the terminated position, thus resisting strain on the wires from causing inadvertent opening and de-termination of the wire. Latching section 140 is seen to be rounded to facilitate delatching to permit intentional pivoting of the wire carrier upwardly when actuation lever 128 is manually pried upwardly. Support section 138 is seen resting upon a protrusion of corresponding support section 142 of the housing for supporting the wire carrier in the open position during insertion of the wire end.

Modifications and variations could be made to the specific embodiments herein disclosed, that would be within the spirit of the invention and the scope of the claims.

What is claimed is:

1. A connector assembly for termination to an insulated wire, comprising:

an insulative housing;

at least one wire carrier pivotably mounted to said housing at a termination location; and a terminal mounted in said housing and including an IDC section defined by a pair of beam portions having an IDC slot therebetween and extending upwardly to an entrance to said IDC slot at upper portions of said beam portions;

said wire carrier having a pivot section at a rear end thereof disposed within a complementary pivot section of said housing, and further having a wire-receiving passageway thereinto from a front face that passes above said entrance to said IDC slot of said terminal when said wire carrier is in a first or open position;

said wire carrier providing a clearance for receiving thereinto said upper portions of said beam portions of said terminal when said wire carrier is pivoted from said open position to a second or closed position after a wire has been inserted into said wire-receiving passageway; and said housing includes a locking section that locks said wire carrier in said closed position after said wire carrier is pivoted to said closed position, wherein the locking section is disposed at a free end of a first post extending upwardly at a front end of said wire carrier, said first post is offset in a first direction laterally from said wire-receiving passageway, and said wire carrier includes a first aperture through which said free end of said first post passes when said wire carrier is pivoted from said open position to said closed position;

whereby the wire carrier urges the wire downwardly past the entrance and into the IDC slot for a conductive core of the wire to be compressively engaged by opposed edges of the beam portions of the terminal as the beam portions penetrate insulation of the wire, thus terminating the wire, and the housing maintains the wire carrier in the closed position.

2. The connector assembly as set forth in claim 1 wherein said wire carrier includes a detent disposed on a depending leg rearwardly of said terminal for maintaining said wire carrier in said open position in cooperation with a corresponding support section of said housing.

3. The connector assembly as set forth in claim 1 wherein said wire carrier includes a stop section disposed on a depending leg rearwardly of said terminal for stopping movement of said wire carrier beyond said open position in cooperation with a corresponding stopping section of said housing.

4. The connector assembly as set forth in claim 1 wherein said housing includes a second post extending upwardly at said front end of said wire carrier and offset in a second direction opposing said first direction laterally from said wire-receiving passageway of said wire carrier, and said wire carrier includes a second aperture through which said free end of said second post passes when said wire carrier is pivoted from said open position to said closed position, said first and second posts anchoring said actuation lever against lateral movement when said wire carrier is in said closed position.

5. The connector assembly as set forth in claim 1 wherein said first aperture is in communication with a slot along a top surface of said wire carrier, so that said locking section latches into and is exposed in said slot proximate said front end of said wire carrier for engagement by a tool for delatching.

6. A connector assembly for termination to an insulated wire, comprising:

an insulative housing;

at least one wire carrier pivotably mounted to said housing at a termination location; and a terminal mounted in said housing and including an IDC section defined by a pair of beam portions having an IDC slot therebetween and extending upwardly to an entrance to said IDC slot, said beam portions having respective upper portions protruding outwardly from said housing toward said wire carrier;

said wire carrier having a pivot section at a rear end thereof disposed within a complementary pivot section of said housing, and further having a wire-receiving passageway thereinto from a front face that passes above said upper portions of said beam portions of said terminal when said wire carrier is in a first or open position;

said wire carrier providing a cavity for receiving thereinto said upper portions of said beam portions of said terminal when said wire carrier is pivoted from said open position to a second or closed position after a wire has been inserted into said wire-receiving passageway, thus urging said wire downwardly past said entrance and into said IDC slot for a conductive core of said wire to be compressively engaged by opposed edges of said beam portions of said terminal as said beam portions penetrate insulation of said wire, thus terminating said wire;

wherein said housing includes a locking section that locks said wire carrier in said closed position, said locking section is defined on an upstanding post that extends through an aperture in said wire carrier; and said terminal includes tab portions that extend from said beam portions orthogonally to stiffen said beam portions against deformation, and said wire carrier includes a clearance for receipt thereinto of said tab portions when pivoted to said closed position.

7. The connector assembly as set forth in claim 6 wherein said wire carrier includes a detent disposed on a depending leg rearwardly of said terminal for maintaining said wire carrier in said open position in cooperation with a corresponding support section of said housing.

8. The connector assembly as set forth in claim 6 wherein said wire carrier includes a stop section disposed on a depending leg rearwardly of said terminal for stopping movement of said wire carrier beyond said open position in cooperation with a corresponding stopping section of said housing.

9. The connector assembly as set forth in claim 6 wherein said locking section is exposed in a slot in said wire carrier proximate a front end thereof for engagement by a tool for delatching.

10. A connector assembly for termination to an insulated wire, comprising:

an insulative housing that holds a terminal having an insulation displacement slot;

a wire carrier pivotably mounted on the housing for movement between an open position and a closed position, the wire carrier having a passageway for receiving the insulated wire when the wire carrier is in the open position, the wire carrier being arranged to move the insulated wire into the insulation displacement slot when the wire carrier is moved to the closed position; and the housing having a locking section that locks the wire carrier in the closed position, the locking section is disposed at a free end of a post, and the wire carrier has an aperture through which the free end passes when the wire carrier is pivoted from the open position to the closed position.

11. The connector assembly according to claim 10, wherein the aperture is offset laterally from the passageway of the wire carrier.

12. The connector assembly according to claim 10, wherein the wire carrier includes a slot in communication with the aperture, and when the wire carrier is in the closed position, the locking section is exposed in the slot for engagement by a tool for delatching.

* * * * *